US008201641B2

(12) United States Patent
Allahar

(10) Patent No.: US 8,201,641 B2
(45) Date of Patent: Jun. 19, 2012

(54) VIBRATING DOWNHOLE TOOL AND METHODS

(75) Inventor: Ian Allahar, Houston, TX (US)

(73) Assignee: Smith International, Inc., Houston, TX (US)

( * ) Notice: Subject to any disclaimer, the term of this patent is extended or adjusted under 35 U.S.C. 154(b) by 157 days.

(21) Appl. No.: 12/724,072

(22) Filed: Mar. 15, 2010

(65) Prior Publication Data

US 2010/0224412 A1 Sep. 9, 2010

Related U.S. Application Data

(63) Continuation-in-part of application No. 12/111,824, filed on Apr. 29, 2008, now Pat. No. 7,708,088.

(51) Int. Cl.
*E21B 7/24* (2006.01)

(52) U.S. Cl. ..... 175/56

(58) Field of Classification Search ..... 175/55, 175/56, 107, 296
See application file for complete search history.

(56) References Cited

U.S. PATENT DOCUMENTS

| | | | | |
|---|---|---|---|---|
| 2,554,005 | A * | 5/1951 | Bodine, Jr. | 175/55 |
| 2,744,721 | A * | 5/1956 | Hatch | 415/121.2 |
| 2,950,901 | A * | 8/1960 | Mathewson, Jr. | 175/55 |
| 3,450,217 | A * | 6/1969 | Wise | 175/56 |
| 3,532,174 | A * | 10/1970 | Hinks et al. | 175/56 |
| 3,807,512 | A * | 4/1974 | Pogonowski et al. | 175/106 |
| 4,384,625 | A | 5/1983 | Roper et al. | |
| 6,039,130 | A | 3/2000 | Pruet | |
| 7,011,156 | B2 * | 3/2006 | von Gynz-Rekowski | 166/301 |
| 7,191,852 | B2 * | 3/2007 | Clayton | 175/55 |
| 7,708,088 | B2 * | 5/2010 | Allahar et al. | 175/55 |
| 7,900,716 | B2 * | 3/2011 | Ibrahim et al. | 175/55 |
| 2001/0023763 | A1 * | 9/2001 | Brett | 166/249 |
| 2005/0121231 | A1 | 6/2005 | Clayton | |
| 2007/0187146 | A1 | 8/2007 | Wylie et al. | |
| 2010/0224412 | A1 | 9/2010 | Allahar | |

FOREIGN PATENT DOCUMENTS

| | | | |
|---|---|---|---|
| GB | 2261238 A | * | 5/1993 |
| RU | 2038461 C1 | * | 6/1995 |
| RU | 2054520 C1 | * | 2/1996 |
| RU | 2100564 C1 | * | 12/1997 |
| SU | 1124116 A | * | 11/1984 |
| SU | 1633087 A | * | 3/1991 |
| SU | 1633087 A1 | | 3/1991 |

OTHER PUBLICATIONS

Combined Search and Examination Report issued in a corresponding British Patent Application No. GB1103945.0; Dated Apr. 4, 2011 (6 pages).
Notification Concerning Transmittal of International Preliminary Report on Patentability (Chapter 1 of the Patent Cooperation Treaty); Dated Nov. 11, 2010 (7 pages).
Examination Report issued in the corresponding British Application No. GB1019388.6; Dated Oct. 18, 2011 (2 pages).
English machine translated Abstract for SU1633087 (1 page).

* cited by examiner

*Primary Examiner* — Daniel P Stephenson
(74) *Attorney, Agent, or Firm* — Osha • Liang LLP

(57) ABSTRACT

A vibrating downhole tool includes a housing having a central axis defined therethrough, an inner mandrel disposed within the housing and configured to receive a drilling fluid, wherein the inner mandrel is misaligned relative to the housing central axis, and a plurality of turbine blades configured to receive the drilling fluid and to rotate the inner mandrel, thereby causing the downhole tool to vibrate.

20 Claims, 3 Drawing Sheets

VIBRATING DOWNHOLE TOOL AND METHODS

CROSS-REFERENCE TO RELATED APPLICATIONS

This application is a continuation-in-part and claims benefit of U.S. application Ser. No. 12/111,824, filed on Apr. 29, 2008, and assigned to the assignee of the present application, which is hereby incorporated by reference in its entirety.

BACKGROUND

1. Field of the Disclosure

Embodiments disclosed herein relate generally to apparatus and methods for creating a vibration within a wellbore. Specifically, the present disclosure relates to a vibrating downhole tool configured to vibrate equipment located within a wellbore.

2. Background Art

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earth formation and proceeds to form a borehole along a predetermined path toward a target zone. As the drill bit creates the wellbore, the drill string and/or the drill bit may become stuck within the wellbore. This may be due to the drill string contacting a wall of the wellbore, particles collapsing on and surrounding the drill bit, or any other situation known in the art.

Typically, when the drill bit and/or drill string becomes stuck, a jar that is coupled to the drill string may be used to free the drill bit and/or the drill string. The jar is a device used downhole to deliver an impact load to another downhole component, especially when that component is stuck. There are two primary types of jars, hydraulic and mechanical. While their respective designs are different, their operation is similar. Energy is stored in the drillstring and suddenly released by the jar when it fires, thereby imparting an impact load to a downhole component.

Additionally, during certain oil and gas operations, downhole components (e.g., packers, anchors, liners, etc.) may become stuck within a wellbore. Typically, a fishing tool that may include a jar, a drill collar, a bumper sub, and an overshot is used to retrieve a downhole component that is stuck. During the retrieval operation, the fishing tool is lowered into a wellbore to a depth near the downhole component. Typically, the overshot is then used to grapple the downhole component. Next, a force (e.g., an impact load) is applied to the downhole component through the use of the jar, which may free the stuck downhole component. The fishing tool may then transport the downhole component to the surface of the wellbore.

Accordingly, there exists a need for methods and apparatuses for improving drilling and retrieval operations in the oil and gas industry.

SUMMARY OF THE DISCLOSURE

In one aspect, embodiments disclosed herein relate to a vibrating downhole tool including a housing having a central axis defined therethrough, an inner mandrel disposed within the housing and configured to receive a drilling fluid, wherein the inner mandrel is misaligned relative to the housing central axis, and a plurality of turbine blades configured to receive the drilling fluid and to rotate the inner mandrel, thereby causing the downhole tool to vibrate.

In other aspects, embodiments disclosed herein relate to a vibrating downhole tool including a housing having a central axis defined therethrough, an inner mandrel disposed within the housing and configured to receive a drilling fluid, and a plurality of turbine blades configured to receive the drilling fluid and to rotate the inner mandrel, thereby causing the downhole tool to vibrate, wherein at least one of the plurality of turbine blades is configured having at least one different property from the remaining turbine blades.

In other aspects, embodiments disclosed herein relate to a method of vibrating a drillstring in a wellbore, the method including providing a vibrating downhole tool in the drillstring prior to inserting the drillstring into the wellbore, providing an angular misalignment between an inner mandrel of the vibrating downhole tool and a central axis of the downhole tool, and pumping a fluid downhole through the drillstring to the downhole tool and rotating the vibrating downhole tool by pumping the fluid through a plurality of turbine blades of the vibrating downhole tool, wherein rotating the misaligned inner mandrel creates vibrations in the drillstring.

Other aspects and advantages of the invention will be apparent from the following description and the appended claims.

DETAILED DESCRIPTION

In one aspect, the present disclosure relates to a vibrating downhole tool configured to vibrate equipment within a wellbore. During operation, the vibrating downhole tool may divert the flow of a drilling fluid through a device that may be configured to rotate at least one component of the vibrating downhole tool, which may cause the downhole tool to vibrate. Subsequently, the equipment that may be coupled to the vibrating downhole tool may also vibrate.

Figure 1:
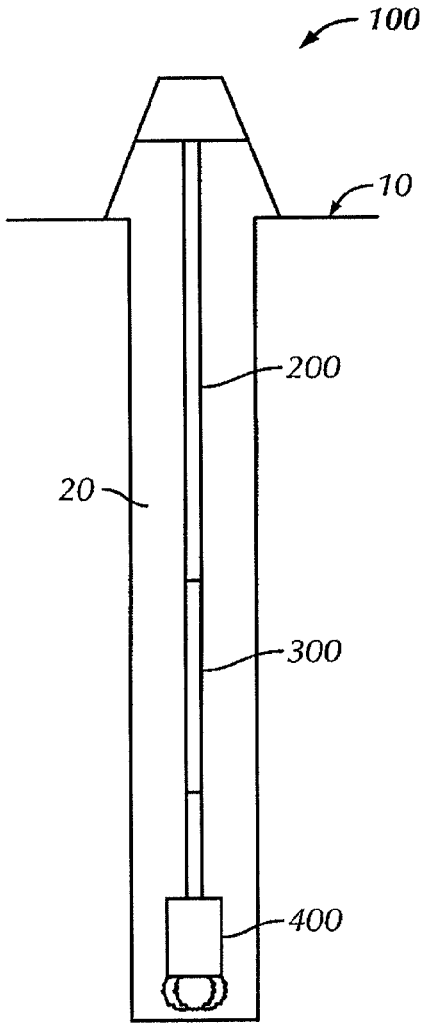
FIG. 1 shows a drilling system in accordance with embodiments of the present disclosure.

Referring now to FIG. 1, a drilling system 100 in accordance with embodiments of the present disclosure is shown. The drilling system 100 includes a drill string 200, a vibrating downhole tool 300, and a drill bit 400. The drilling system 100 is configured to drill a wellbore 20 and create a vibration that may be transferred into the drill string 200 and/or the drill bit 400 located below a surface of the wellbore 10. One of ordinary skill in the art will appreciate that the drill system 100 may include other tools, such as stabilizer, motors, etc.

The drill string 200 is coupled to the vibrating downhole tool 300 and the drill bit 400. As known to one skilled in the art the vibrating downhole tool 300 and the drill bit may be coupled to the drill string 200 through the use of threads, bolts, welds, or any other attachment feature known in the art. Further, the drill string 200 is configured to transfer a drilling fluid downhole to the vibrating downhole tool 300 and the drill bit 400. For example, the drill string 200 may include at least one drill pipe (not shown) having a bore (not shown) that allows the drilling fluid to pass through the drillstring 200.

The drill bit 400 is configured to crush or shear particles located at the bottom of the wellbore 20, thereby increasing the depth of the wellbore 20. In one embodiment, the drill bit 400 may include a fixed cutter drill bit configured to shear the particles at the bottom of the wellbore 20. In another embodiment, the drill bit 400 may include a roller cone bit configured to crush particles at the bottom of the wellbore 20.

Figure 2A:
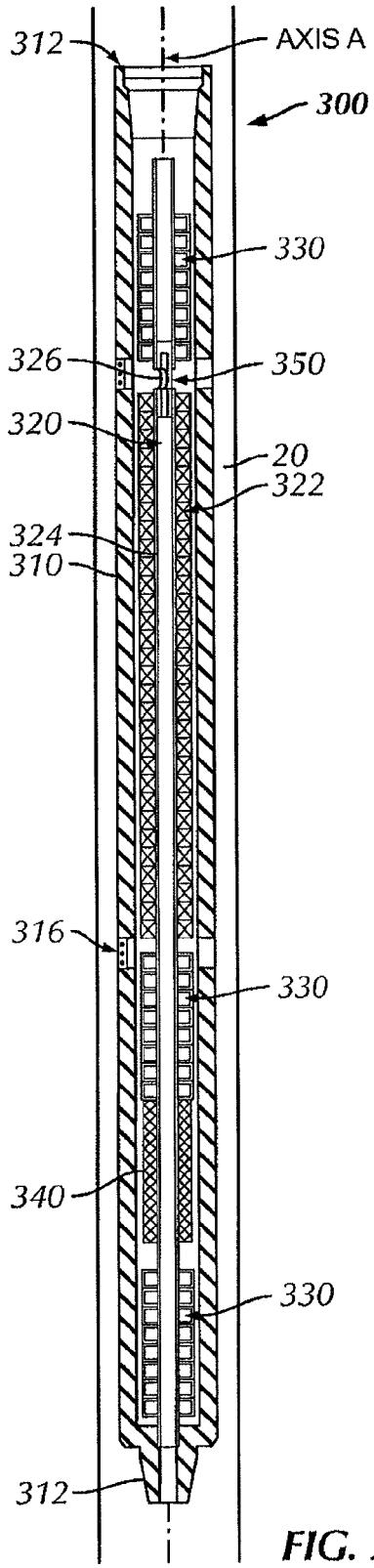
FIG. 2A shows a cross-sectional view of a vibrating downhole tool in accordance with embodiments of the present disclosure.

Referring now to FIG. 2A, a cross-sectional view of the vibrating downhole tool 300 is shown in accordance with embodiments of the present disclosure. The vibrating downhole tool 300 includes a housing 310 with connections 312, which allows the vibrating downhole tool 300 to be coupled to the drill string 200 (FIG. 1) and/or the drill bit 400 (FIG. 1). Further, the vibrating downhole tool 300 includes an inner mandrel 320, bearing packs 330, a mass 340 coupled to the inner mandrel 320, and a flow control device 350.

The bearing packs 330 are coupled to an outer surface 324 of the inner mandrel 320 and are located at various axial locations along the inner mandrel 320. One skilled in the art will understand appropriate locations for the bearing packs 330 on the inner mandrel 320. As shown, the bearings 330 are disposed between the inner mandrel 320 and the housing 310. The bearings 330 are configured to allow the inner mandrel 320 to rotate independently from the housing 310. The bearings 330 may include ball bearings, fluid bearings, jewel bearings, or other bearings known in the art.

Both the inner mandrel 320 and the bearing packs 330 are disposed within the housing 310. One or more apertures 326 in the sidewall of the inner mandrel 320 are configured to allow drilling fluid, which typically flows through a hollow central section of the inner mandrel 320 when the downhole tool 300 is not in use, to be rerouted and to flow outside the inner mandrel 320 and through a plurality of turbine blades 322 coupled to the outer surface 324 of the inner mandrel 320. Fluid flow through the plurality of turbine blades 322 causes the inner mandrel 320 to rotate about axis A.

Referring still to FIG. 2A, the flow control device 350 is configured to reroute the flow of the drilling fluid from through the inner mandrel 320 to through the plurality of turbine blades 322. Accordingly, during operation, the flow control device 350 may be used to selectively activate the vibrating downhole tool. In one embodiment, the flow control device 350 may include a ball drop nozzle (not shown) configured to receive a neoprene ball or a ball of any other material known in the art. During operation, the neoprene ball may be pumped down the drill string 200 and seated in the ball drop nozzle. Consequently, the drilling fluid would be forced to flow outward through the aperture 326 in the inner mandrel 320 and down through the plurality of turbine blades 322.

In another embodiment, the flow control device 350 may include a valve (not shown) configured to control the flow of the drilling fluid through the inner mandrel 320 and the aperture 326 in the inner mandrel 320. For example, the valve may be positioned proximate the aperture 326 and actuated to direct at least a portion of the drilling fluid in the inner mandrel 320 through the aperture 326. The drilling fluid may then flow through the plurality of turbine blades 322 and through at least one annular port 316 of the housing 310.

In certain embodiments, the flow control device 350 may include an RFID Tag (not shown) that may be used to control the flow control device 350. For example, a controller (not shown) may be electronically coupled to the RFID tag. Further, the controller may send a signal to the flow control device 350 that may be received by the RFID tag and used to actuate the flow control device 350, thereby diverting at least a portion of the drilling fluid through the aperture 326 in the inner mandrel 320. Additionally, in some embodiments, the flow control device 350 may include a sensor that receives a signal from the RFID tag that may be used to actuate the flow control device 350.

As depicted, the housing 310 is configured to protect and contain components (i.e., bearing packs 330, inner mandrel 320, mass 340, etc.) of the vibrating downhole tool 300. Furthermore, the housing 310 may also include at least one annular port 316 that provides a path for at least a portion of the drilling fluid to be released from the vibrating downhole tool 300. For example, during operation, at least a portion of the drilling fluid may pass through the aperture 326 in the inner mandrel 320 and through the plurality of turbine blades 322. Once the drilling fluid has passed through the plurality of turbine blades 322, it may then pass out of the housing 310 through the annular port 316 and into the wellbore 20.

Figure 2B:
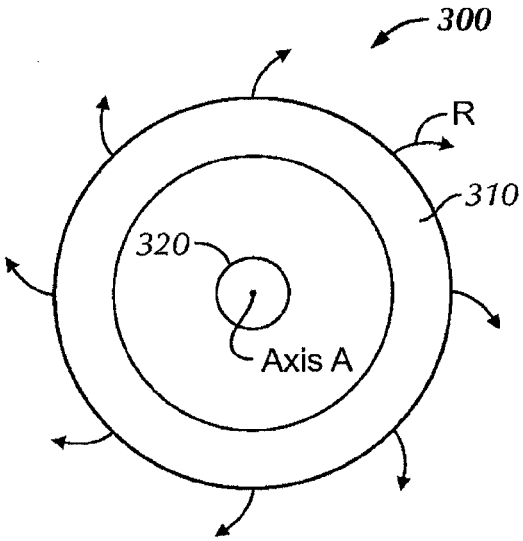
FIG. 2B shows a top view of a vibrating downhole tool in accordance with embodiments of the present disclosure.

Further, as shown in FIG. 2A, the mass 340 is coupled to the inner mandrel 320 of the vibrating downhole tool 300. The mass 340 may be coupled to the inner mandrel 320 by bolts, welding, or any other attachment method known in the art. As such, the mass 340 is configured to be rotated around axis A by the inner mandrel 320. In one embodiment, the mass 340 may be eccentric of unbalanced. As used herein, "eccentric" refers to a mass having a center of gravity that is offset from an axis that the mass is rotated around (e.g., axis A). As the eccentric mass 340 is rotated by the inner mandrel 320, a centrifugal force created by a rotation of the eccentric mass 320 may cause the vibrating downhole tool 300 to be displaced. In one embodiment, the rotation of the eccentric mass causes the vibrating downhole tool to be displaced in an outward direction R, as shown in FIG. 2B. Consequently, the displacement of the vibrating downhole tool 300 creates a radial and/or axial vibration, which may be used to vibrate the drill string 200 or other components disposed within the wellbore 20, such as, the drill bit 400. In certain embodiments, the mass 340 may include at least one opening (not shown) that will allow inserts (not shown) to be added and removed from the mass 340, thereby allowing a weigh of the mass 340 to be increased.

Further, in certain embodiments, the inner mandrel 320 may be misaligned or oriented within the housing 310 such that the inner mandrel 320 is not perfectly aligned in the axial direction (i.e., from the top to bottom of the housing 310). Misalignment of the inner mandrel 320 may be accomplished in a number of ways. For example, the entire inner mandrel 320 may be misaligned within the housing 310 so that a central axis of the inner mandrel 320 is misaligned relative to central axis A, shown in FIG. 2A. In another example, the inner mandrel 320 may have a bend at a particular location along its length. Thus, one section of the inner mandrel 320 may be aligned with the housing 310 and axis A, while a second section of the inner mandrel 320 may be misaligned with the housing 310 and axis A. Moreover, both sections of the inner mandrel 320 on either side of the bend may be misaligned with the housing 310 and axis A. The location of the bend may vary along the length of the inner mandrel 320. In certain embodiments, the bend may be located near the mass 340. Further, in certain embodiments there may be multiple bends located along a length of the inner mandrel 320.

In certain embodiments, the inner mandrel 320 may be misaligned within a range from about 0 degrees to about 10 degrees from central axis A. In other embodiments, the inner mandrel 320 may be misaligned from about 0 degrees to about 5 degrees from central axis A. Thus, because of the misalignment, rotation of the inner mandrel 320 will result in an eccentric motion resulting in vibration and lateral displacement of the downhole tool about its axis. Mass 340 may be either eccentric or balanced such that when inner mandrel 320 is rotated, the mass 340 amplifies or accentuates the vibrations in the downhole tool caused by the misaligned inner mandrel 320. As used herein, "balanced" refers to a mass having a center of gravity that is aligned with an axis that the mass is rotated around (e.g., axis A).

Still further, in other embodiments, the plurality of turbine blades 322 (FIG. 2A) may be configured having different "properties" to cause an eccentric motion of the inner mandrel when it is rotated. Properties of the plurality of turbine blades may include, but are not limited to, blade size, blade shape, blade mass, blade profile, and other blade configurations to create vibrations. For example, altered blade sizes may include individual turbine blades having different surface area sizes. In another example, altered blade shapes (shape of the blade face) may include square or rectangular-shaped blades, circle or semi-circular-shaped blades, triangular-shaped blades, or any other blade shape known to those skilled in the art. In further examples, altered blade masses may include various blades in the plurality of turbine blades having different masses. Altered blade masses and altered blade sizes may be related properties (i.e., increasing or decreasing blade size may also increase or decrease blade mass, and vice versa). In another example, altered blade profiles (cross-sectional profile) may include flat profiles, curved profiles, faceted profiles, and any other blade profile known to those skilled the art.

Embodiments disclosed herein may include combinations of any and/or all of the features described that are configured to induce vibrations in the downhole tool. For example, a particular downhole tool in accordance with embodiments disclosed herein may include a mass (balanced or eccentric) coupled to the inner mandrel, a misaligned inner mandrel, and/or a plurality of turbine blades having different properties, all of which are configured to cause vibrations in the downhole tool when the inner mandrel is rotated. Those skilled in the art will understand various combinations of all of the features described herein.

Figure 3:
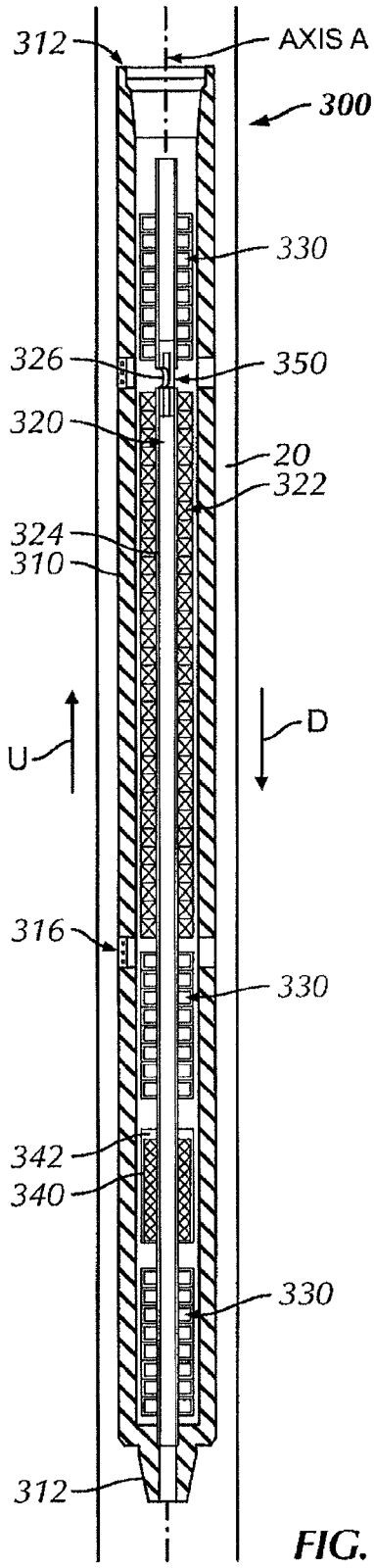
FIG. 3 shows a cross-sectional view of a vibrating downhole tool in accordance with embodiments of the present disclosure.

Referring now to FIG. 3, in select embodiments, the mass 340 may include a sleeve 342 configured to translate in an upward direction U and a downward direction D as the mass 340 is rotated. The upward and downward translation of the sleeve 342 may cause the vibrating downhole tool 300 to be displaced in the upward and downward direction U, D. Accordingly, the displacement of the vibrating downhole tool 300 creates a vibration that may be used to axially vibrate the drill string 200 and/or other components within the wellbore 20.

Referring back to FIGS. 1 and 2A, during operation of the drilling system 100, the drilling fluid is pumped through the drill string 200 to the vibrating downhole tool 300 located below the surface 10. The drilling fluid then flows into the inner mandrel 320 of the vibrating downhole tool 300. Next, the inner mandrel 320 transfers the drilling fluid through the vibrating downhole tool 300. While the drilling fluid is being transferred through the vibrating downhole tool 300, the flow control device 350 may be selectively actuated to divert a portion of the drilling fluid through the aperture 326 of the inner mandrel 320. The diverted portion of drilling fluid will then flow through the plurality of turbine blades 322, thereby causing the inner mandrel 320 and mass 340 to rotate. Rotation of the inner mandrel 320 in conjunction with at least one of the features described above (mass 340, misaligned inner mandrel 320, and/or the plurality of turbine blades 322 having different properties) will result in an eccentric motion of the downhole tool resulting in vibration and lateral displacement of the downhole tool about its axis. One skilled in the art will appreciate that the vibration created by the vibrating downhole tool 300 may be used to vibrate the drillstring 200 and/or other components, such as the drill bit 400. After the diverted portion of drilling fluid has passed through the plurality of turbine blades 322, the diverted portion of drilling fluid flows through the annular port 316 of the housing 310 and into the wellbore 20.

In one embodiment, the drilling fluid that is allowed to pass through the vibrating downhole tool 300 flows into the drill string 200 below the vibrating downhole tool 300 and onto the drill bit 400 located at the bottom of the wellbore 20. In an alternate embodiment, the drilling fluid that is allowed to pass through the vibrating downhole tool 300 flows directly into the drill bit 400.

In certain embodiments, during operation, the flow control device 350 may control a flow rate of the portion of the drilling fluid passing through the plurality of turbine blades 322. In one embodiment, the flow control device 350 may be further actuated to increase the flow rate of the portion of the drilling fluid passing through the plurality of turbine blades 322. In another embodiment, the flow control device 350 may be de-actuated to decrease the flow rate of the portion of drilling fluid passing through the plurality of turbine blades 322.

As known by one skilled in the art, controlling the flow rate of the portion of drilling fluid passing through the plurality of turbine blades 322 may allow a frequency of the vibration created by the vibrating downhole tool to be controlled. For example, as the flow rate of the portion of the drilling fluid passing through the plurality of turbines 322 increases, a rotational speed of the mass 340 coupled to the inner mandrel 320 increases. As the rotational speed of the mass 340 increases, the vibrating downhole tool 300 may be displaced more often over a certain period of time, thereby increasing the frequency of vibrations created by the vibrating downhole tool 300.

Further, in certain embodiments, the vibrating downhole tool 300 may include a motor (not shown), such as a positive displacement motor (PDM), an electric motor, or any other motor known in the art. The motor may configured to selectively rotate the inner mandrel 320 and the mass 340, thereby selectively activating the vibrating downhole tool 300 during operation. In one embodiment, the motor may be coupled to the inner mandrel 320 and the mass 340 and a power supply (not shown). As such, the power supply may selectively provide the motor with an electric power, which may be used to rotate the motor, thereby causing the vibrating downhole tool 300 to vibrate.

Figure 4:
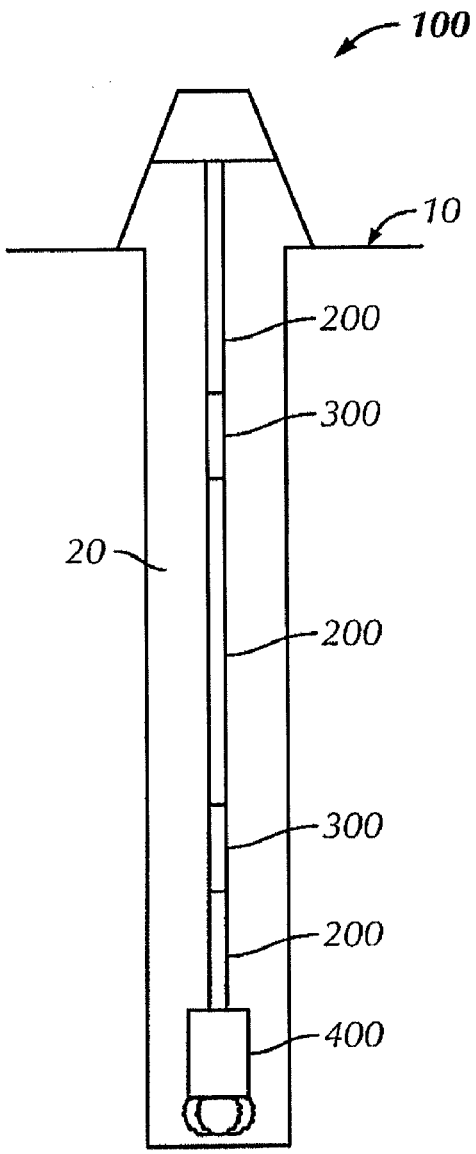
FIG. 4 shows a drilling system in accordance with embodiments of the present disclosure.

Furthermore, in certain embodiments, the drilling system 100 may include a plurality of vibrating downhole tools 300 coupled to the drill string 200 and positioned at various depths within the wellbore 20, as shown in FIG. 4. This may allow the drilling system 100 to selectively vibrate various sections of the drill string 200. Additionally, one skilled in the art will appreciate that when at least one of the plurality of vibrating downhole tools 300 is inoperable, another of the plurality of vibrating downhole tools 300 may be used to vibrate the drill string 200, thereby increasing the reliability of the drilling system 100.

Figure 5:
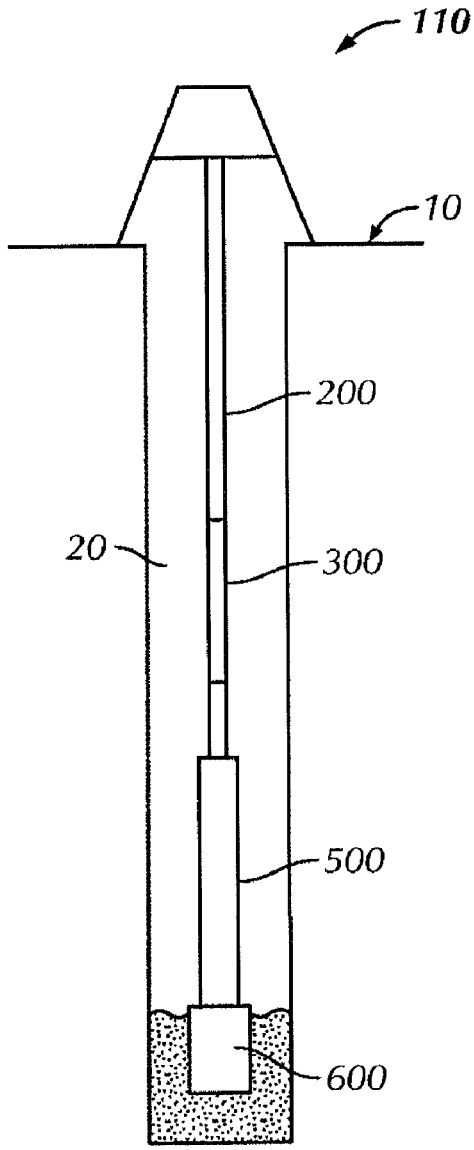
FIG. 5 shows a fishing system in accordance with embodiments of the present disclosure.

During oil and gas operations, downhole components (e.g., packers, anchors, liners, etc.) may become stuck within the wellbore. Accordingly, one skilled in the art will appreciate that the vibrating downhole tool 300 may be incorporated within a fishing system to retrieve a downhole component that is stuck. For example, referring now to FIG. 5, a fishing system 110 in accordance in with embodiments of the present disclosure is shown. In one embodiment, the fishing system 110 includes a fishing tool 500, a drill string 200, and a vibrating downhole tool 300. The drill string 200 is configured to transport a fluid downhole to the fishing tool 500 and/or the vibrating downhole tool 300. Generally, as known to one skilled in the art, the fishing tool 500 includes a jar (not shown), a drill collar (not shown), a bumper sub (not shown), and an overshot (not shown) configured to retrieve at least one piece of downhole equipment 600. As described above, the vibrating downhole tool 300 is configured to receive the fluid from the drill string 200 and create a vibration. During operation, the vibrating downhole tool 300 may be configured to receive the fluid pumped downhole through the drill string 200. Further, the vibrating downhole tool 300 may vibrate the drill string 200 and/or the at least one piece of downhole equipment 600 that is stuck to assist the fishing tool 500 in freeing and retrieving the at least one piece downhole equipment 600.

Advantageously, embodiments of the present disclosure may improve movement of equipment within a wellbore during operations. The vibration created by the vibrating downhole tool may displace the drillstring away from the wall of the wellbore, thereby reducing the friction between the wall of the wellbore and the drill string. Because the friction between the wall of the wellbore and the drill string is reduced the drill string may move more easily within the wellbore. Further, the vibration may also displace the downhole component attached to the drill string. In one example, this may prevent the downhole components (i.e., drill bit, stuck pieces of equipment) from getting stuck during operation.

Additionally, embodiments of the present disclosure provide a system configured to retrieve a downhole component stuck within a wellbore. The vibration created by the vibrating downhole tool of the system may displace the downhole component, which may assist in freeing the downhole equipment stuck within the wellbore. Furthermore, embodiments of the present disclosure may provide a vibrating downhole tool configured to be selectively activated during operation. The vibrating downhole tool may include a device (e.g., flow control device) configured to be actuated, thereby activating the vibrating downhole tool.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A vibrating downhole tool comprising:

a housing having a central axis defined therethrough;

an inner mandrel disposed within the housing and configured to receive a drilling fluid, wherein a central axis of the inner mandrel is misaligned relative to the housing central axis; and a plurality of turbine blades configured to receive the drilling fluid and to rotate the inner mandrel, thereby causing the downhole tool to vibrate.

2. The downhole tool of claim 1, wherein at least one of the plurality of turbine blades is configured having at least one of a different property from the remaining turbine blades.

3. The downhole tool of claim 2, wherein the at least one of a different property of the at least one of the plurality of turbine blades is selected from a group consisting of blade size, shape, mass, and profile.

4. The downhole tool of claim 1, further comprising a flow control device configured to selectively allow fluid to pass through an aperture in the inner mandrel and engage the plurality of turbine blades.

5. The downhole tool of claim 4, wherein the flow control device comprises a radio tag system.

6. The downhole tool of claim 4, wherein the flow control device comprises a ball drop device.

7. The downhole tool of claim 1, further comprising a mass coupled to the inner mandrel.

8. The downhole tool of claim 7, wherein the mass comprises an eccentric mass.

9. The downhole tool of claim 1, wherein the inner mandrel comprises at least one bend along its axial length.

10. A vibrating downhole tool comprising:

a housing having a central axis defined therethrough;

an inner mandrel disposed within the housing and configured to receive a drilling fluid; and a plurality of turbine blades configured to receive the drilling fluid and to rotate the inner mandrel, thereby causing the downhole tool to vibrate;

wherein at least one of the plurality of turbine blades is configured having at least one different property from the remaining turbine blades.

11. The downhole tool of claim 10, wherein the different property of the at least one of the plurality of turbine blades is selected from a group consisting of blade size, shape, mass, and profile.

12. The downhole tool of claim 10, wherein the inner mandrel is configured having an angular misalignment relative to the housing central axis.

13. The downhole tool of claim 10, further comprising a flow control device configured to selectively allow fluid to pass through an aperture in the inner mandrel and engage the plurality of turbine blades.

14. The downhole tool of claim 13, wherein the flow control device comprises a radio tag system.

15. The downhole tool of claim 13, wherein the flow control device comprises a ball drop device.

16. The downhole tool of claim 10, further comprising a mass coupled to the inner mandrel.

17. The downhole tool of claim 16, wherein the mass comprises an eccentric mass.

18. A method of vibrating a drillstring in a wellbore, the method comprising:

providing a vibrating downhole tool in the drillstring prior to inserting the drillstring into the wellbore;

providing an angular misalignment between a central axis of an inner mandrel of the vibrating downhole tool and a central axis of the downhole tool; and pumping a fluid downhole through the drillstring to the downhole tool and rotating the vibrating downhole tool by pumping the fluid through a plurality of turbine blades of the vibrating downhole tool;

wherein rotating the misaligned inner mandrel creates vibrations in the drillstring.

19. The method of claim 18, further comprising providing at least one of the plurality of turbine blades having a different property from the remaining turbine blades.

20. The downhole tool of claim 19, wherein the different property of the at least one of the plurality of turbine blades is selected from a group consisting of blade size, shape, mass, and profile.

* * * * *